US009393684B2

(12) United States Patent
Christopher et al.

(10) Patent No.: US 9,393,684 B2
(45) Date of Patent: Jul. 19, 2016

(54) TOOLBOX

(71) Applicant: Meridian International Co., Ltd., Songjiang, Shanghai (CN)

(72) Inventors: Brent Christopher, Centennial, CO (US); Cui Feng Wang, Shanghai (CN)

(73) Assignee: Meridian International Co., Ltd. (CN)

( * ) Notice: Subject to any disclaimer, the term of this patent is extended or adjusted under 35 U.S.C. 154(b) by 42 days.

(21) Appl. No.: 14/242,412

(22) Filed: Apr. 1, 2014

(65) Prior Publication Data

US 2015/0274362 A1 Oct. 1, 2015

(51) Int. Cl.

| | |
|---|---|
| ***B65D 21/036*** | (2006.01) |
| ***B25H 3/02*** | (2006.01) |
| *B65D 21/02* | (2006.01) |
| *B65D 25/28* | (2006.01) |

(52) U.S. Cl.

CPC ..... *B25H 3/02* (2013.01); *B65D 21/0219* (2013.01); *B65D 21/022* (2013.01); *B65D 21/0222* (2013.01); *B65D 21/0223* (2013.01); *B65D 25/282* (2013.01)

(58) Field of Classification Search

CPC ..... B65D 21/0212; B65D 21/0217; B65D 21/0219; B65D 21/022; B65D 21/0222; B65D 21/0223; B65D 21/023; B65D 45/16; B65D 45/18; B65D 45/20; B65D 45/22; B65D 45/025

USPC ..... 220/326

See application file for complete search history.

(56) References Cited

U.S. PATENT DOCUMENTS

| | | | | |
|---|---|---|---|---|
| 4,619,363 | A | 10/1986 | Wolfseder | |
| 5,011,013 | A | 4/1991 | Meisner et al. | |
| 6,193,062 | B1 | 2/2001 | Rysgaard et al. | |
| 6,371,320 | B2 | 4/2002 | Sagol | |
| 8,602,217 | B2 | 12/2013 | Sosnovsky et al. | |
| 2003/0062365 | A1 * | 4/2003 | Krueger | 220/4.24 |
| 2003/0094392 | A1 | 5/2003 | Meier et al. | |
| 2011/0049824 | A1 | 3/2011 | Bar-Erez et al. | |
| 2011/0139777 | A1 | 6/2011 | Sosnovsky et al. | |
| 2011/0155613 | A1 | 6/2011 | Koenig et al. | |
| 2011/0168599 | A1 | 7/2011 | Koenig et al. | |
| 2012/0312812 | A1 | 12/2012 | Sosnovsky et al. | |
| 2012/0326406 | A1 | 12/2012 | Lifshitz et al. | |

FOREIGN PATENT DOCUMENTS

| | | |
|---|---|---|
| CN | 203427004 | 2/2014 |
| DE | 202013003741 | 4/2013 |

(Continued)

OTHER PUBLICATIONS

Boschtools.com "L-boxx" products, Model #: L-BOXX-1, L-BOXX-2, L-BOXX-3, L-BOXX-4, http://www.boschtools.com/Products/Tools/Pages/ItemResults.aspx?catid=1611, Date unknown but prior to U.S. filing date.

(Continued)

*Primary Examiner* — Stephen Castellano

(74) *Attorney, Agent, or Firm* — Jason R. Sytsma; Shuttleworth & Ingersoll, PLC

(57) ABSTRACT

A container assembly system includes two containers that are nestingly engaged on top of each other. Each has a cooperating male locating projection and a female locating recess. The male locating projection of one of the containers fits in the female locating recess of the other container and the male locating projection of such one container fits in the female locating recess of such other container.

7 Claims, 13 Drawing Sheets

(56) References Cited

FOREIGN PATENT DOCUMENTS

| | | |
|---|---|---|
| EP | 0555533 | 8/1993 |
| EP | 1059240 | 12/2000 |
| EP | 1238602 | 9/2002 |
| EP | 1516703 | 3/2005 |
| EP | 2402259 | 1/2012 |
| JP | 2005162223 | 6/2005 |

OTHER PUBLICATIONS festoolproducts.com "T-Loc" products, Model #: SYS 1, SYS 2, SYS 3, SYS 4, SYS 5, http://www.festoolproducts.com/Systainer-Storage-System-s/75.htm: Date unknown but prior to U.S. filing date.

dewalt.com, "TSTAK" products, Model #: DWST08201, DWST08203, DWST08204, http://www.dewalt.com/tool-categories/hand-tools-storage-and-work-support-mobile-work-shop-storage.aspx. Date unknown but prior to U.S. filing date.

dewalt.com, "Tough System" products, Model #: DWST17804, DWST17803, DWST17807, http://www.dewalt.com/tool-categories/hand-tools-storage-and-work-support-tstak.aspx, Date unknown but prior to U.S. filing date.

Patent Examination Report issued by the Australian Patent Office on Jul. 14, 2014 for counterpart Australian Patent Application No. 2014202834.

Patent Examination Report issued by the Australian Patent Office on Dec. 15, 2014 for counterpart Australian Patent Application No. 2014202834.

* cited by examiner

TOOLBOX

FIELD OF THE INVENTION

The present invention relates to a container storage system, and more particularly, to a container storage system having containers that can be connected together.

BACKGROUND

Tool storage systems are commonly used by businesses and consumers to store and organize tools, spare parts, fasteners, and the like. Tool storage systems range from single cabinets with one storage receptacle to systems with multiple cabinets, each with multiple storage receptacles configured to meet a variety of needs. Existing storage systems suffer from several shortcomings. Therefore there is a constant need in the industry to improve upon existing container storage systems by making them more efficient, easy to use, modular, and/or multifunctional.

SUMMARY OF THE INVENTION

A container assembly system is disclosed. The system includes at least a first container and a second container. The first container has a first opening into a first interior space for storing articles, and a first cover for closing the first opening. A handle is provided for carrying the first container. A cooperating male locating projection and a female locating recess are also provided. The second container similarly has a second opening into a second interior space for storing articles and a second cover for closing the second opening. A container latching mechanism that moves between a latched position and an unlatched position, connects the second container to the handle of the first container. A cooperating female locating recess and a male locating projection are also provided.

The first container nestingly engages with the second container when the second container is positioned on top of the first container. The male locating projection of the first container fits in the female locating recess of the second container and the male locating projection of the second container fits in the female locating recess of the first container. This arrangement provides two locating devices to hold the first and second container together to prevent latitudinal and longitudinal movement of the first container with respect to the second container, while the container latching mechanism and the handle hold the respective containers together for carrying or moving as a unit.

DETAILED DESCRIPTION

Figure 1A:
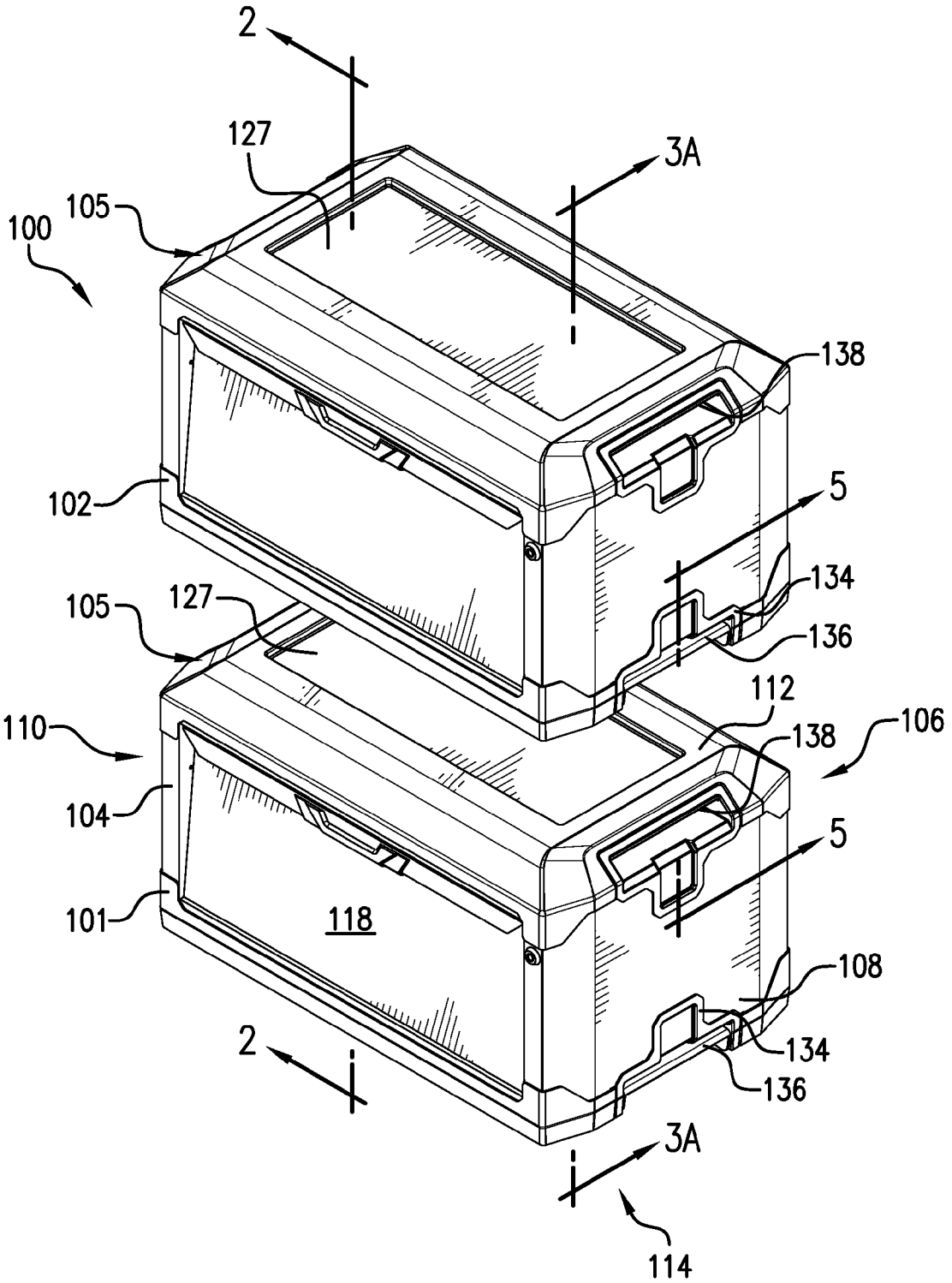
FIG. 1A shows a front top-side perspective view of a container storage assembly system in accordance with an embodiment of the present disclosure.
Figure 1B:
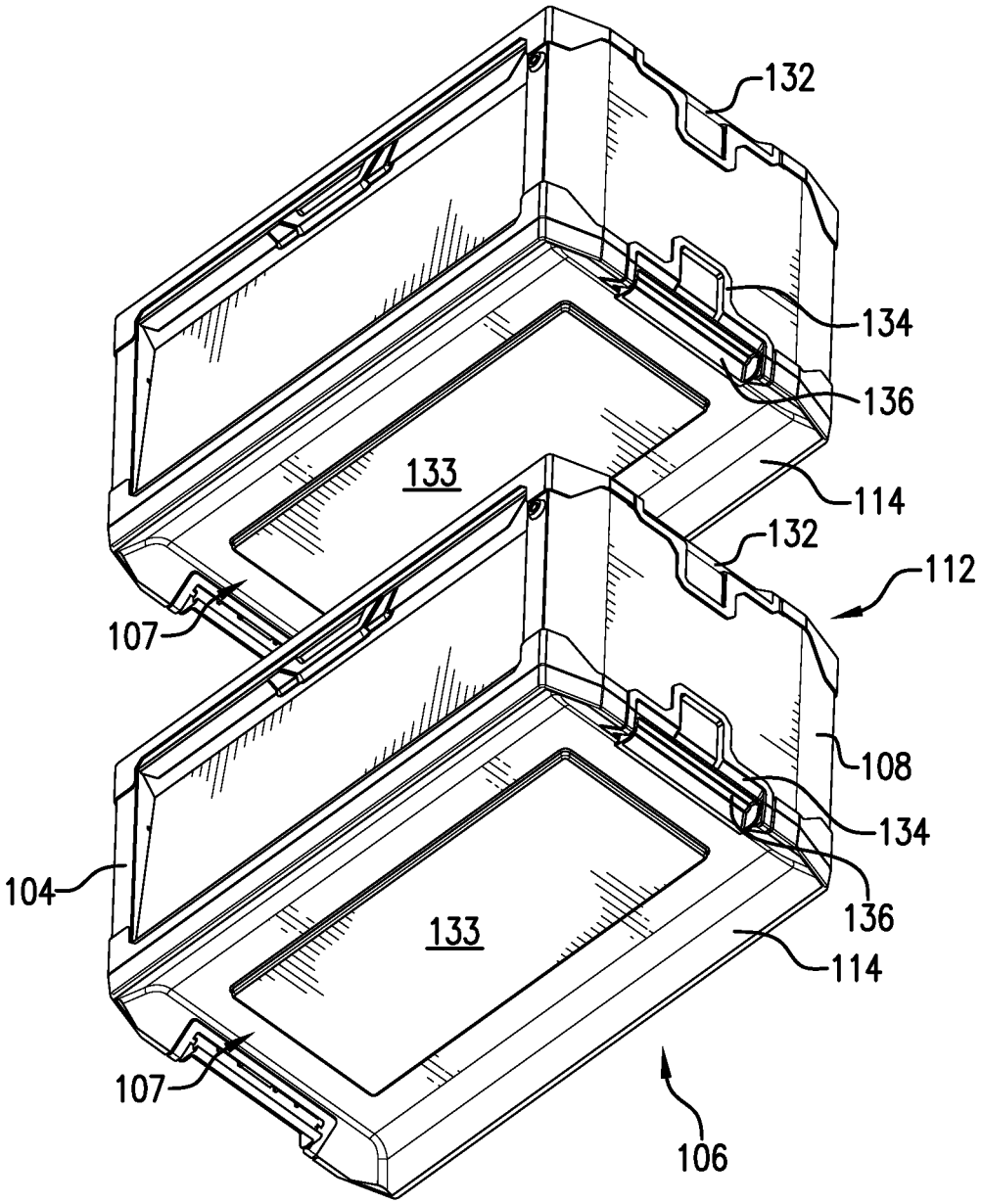
FIG. 1B shows a front bottom-sides perspective view of the container storage assembly system of FIG. 1A.
Figure 7:
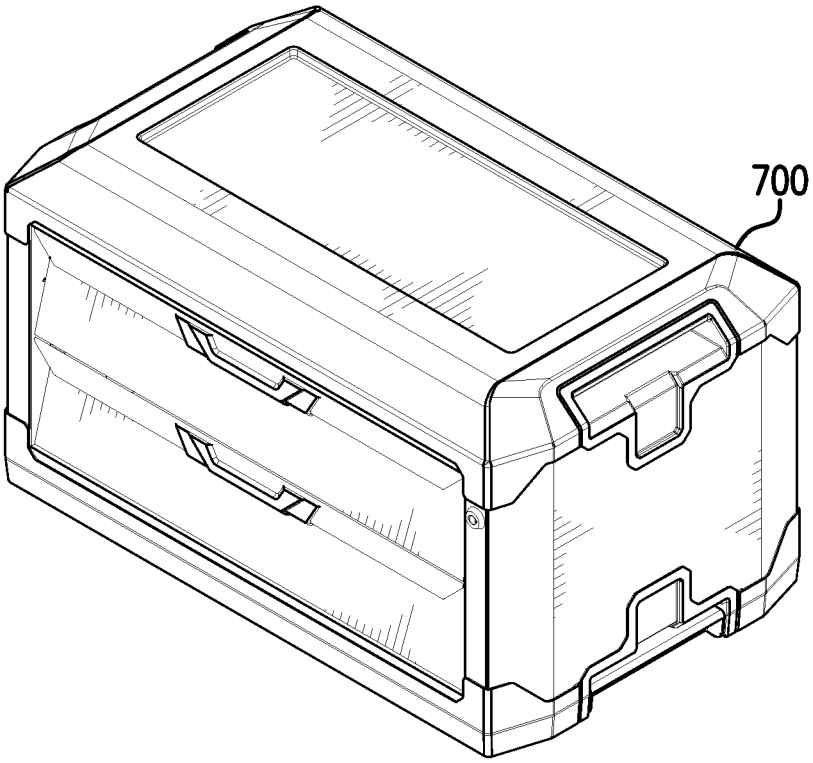
FIG. 7 is an alternative embodiment of a container in a container storage assembly system.
Figure 8:
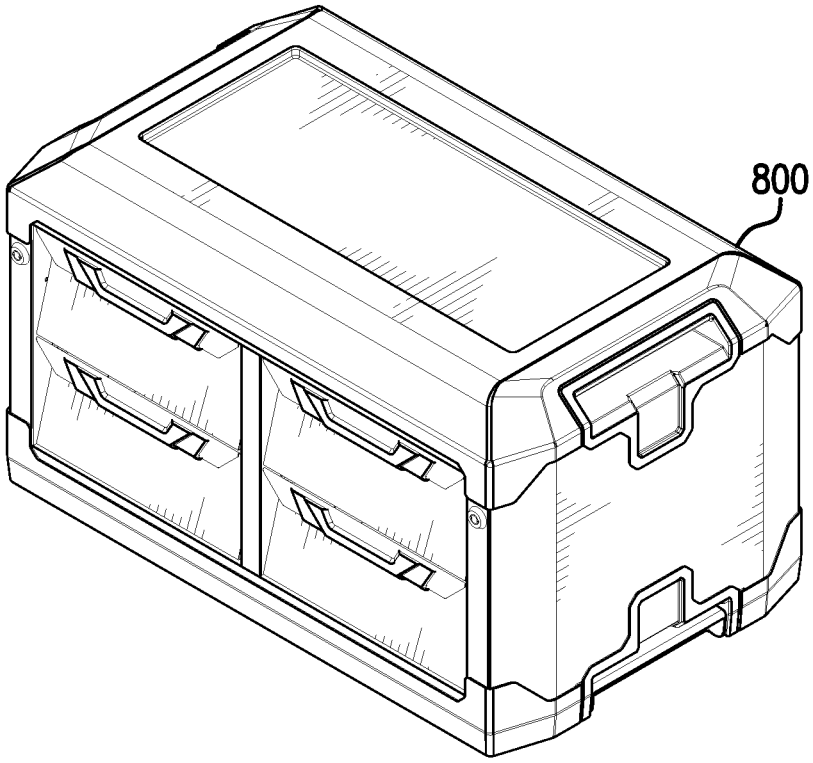
FIG. 8 is another embodiment of a container in a container storage assembly system.
Figure 9:
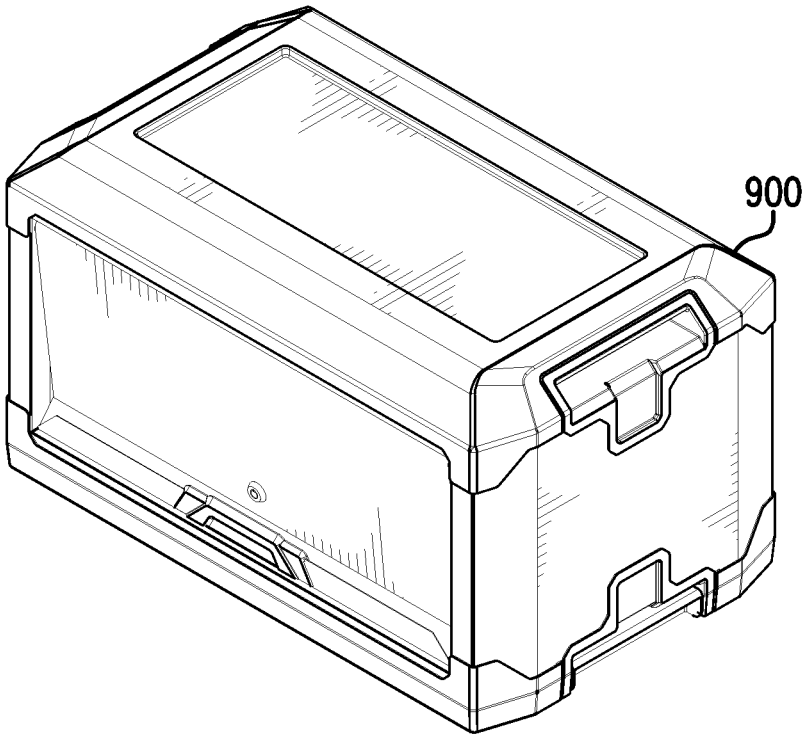
FIG. 9 is yet another embodiment of a container in a container storage assembly system.
Figure 10:
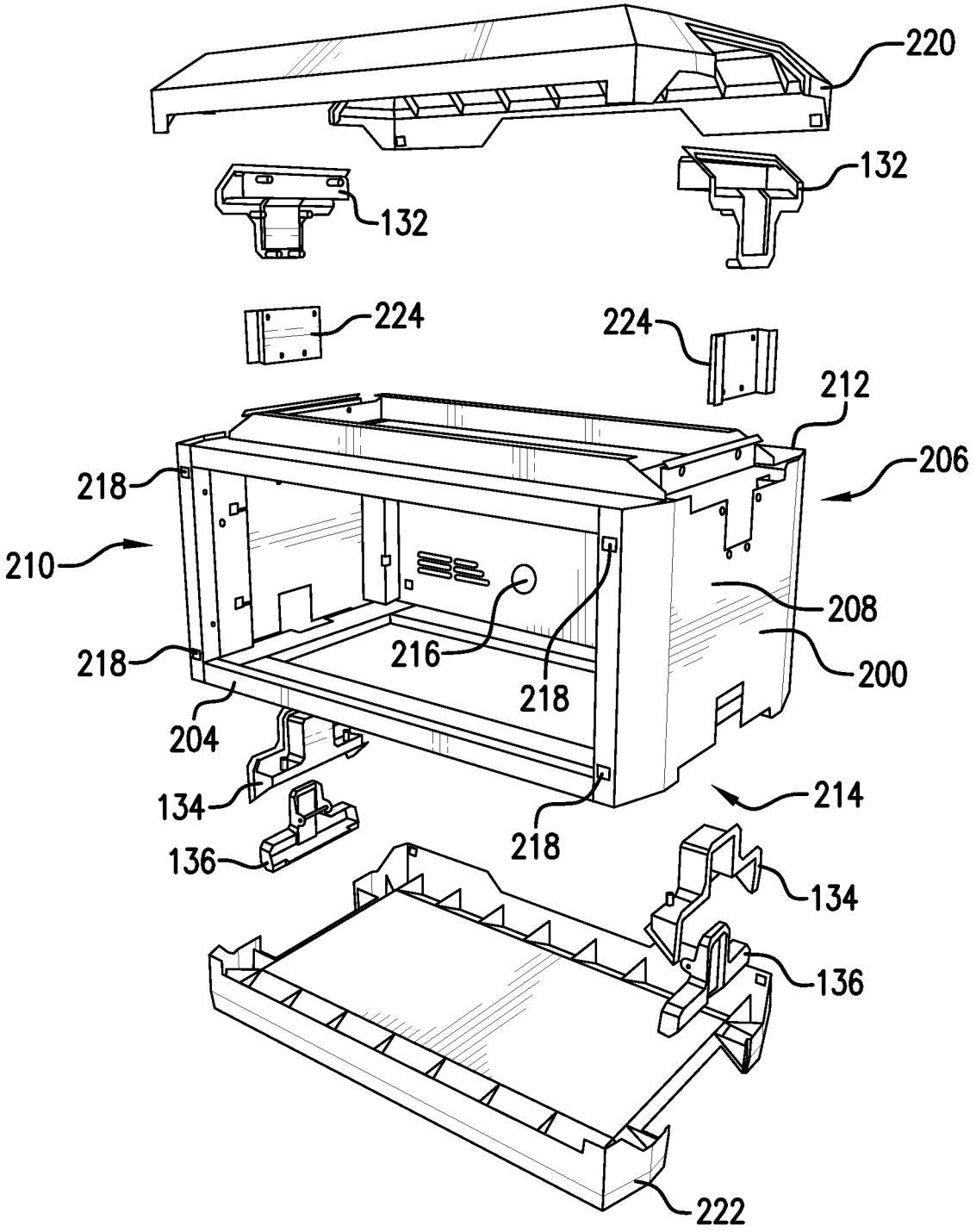
FIG. 10 is an exploded view of a container in the container storage assembly system of FIG. 1.

FIG. 1 shows a container storage assembly system 100 in accordance with an embodiment of the present disclosure. System 100 includes a first container 101 and a second container 102 constructed and arranged to be connected together. Each container 101 and 102 are generally the same so that first container 101 and second container 102 can be connected together with either on the top or the bottom, and either connected in any arrangement with one or more alternative embodiments of containers 700, 800, and 900, shown in FIGS. 7-9, respectively. Such a system 100 allows for a reconfigurable storage assembly system 100 with a wide variety of containers. An exploded view of containers 101 and 102 is shown in FIG. 10.

Containers 101 and 102 are the same, so for simplicity and brevity, only container 101 is described. Container 101 has a front side 104, a back side 106, a right side 108, a left side 110, a top side 112, and a bottom side 114. Together these sides 104-114, respectively, define an interior space 116 for storing articles that can be accessible by extending a front cover 118 of a drawer. Interior space 116, in alternative embodiments, can be accessible by removing or moving any cover combined with any side 104-114 in any manner, such as a pivoting top cover combined with top side 112 or pivoting front cover combined with front side 104. A locking mechanism, such as a key latch, can lock the front cover to the container.

Figure 2A:
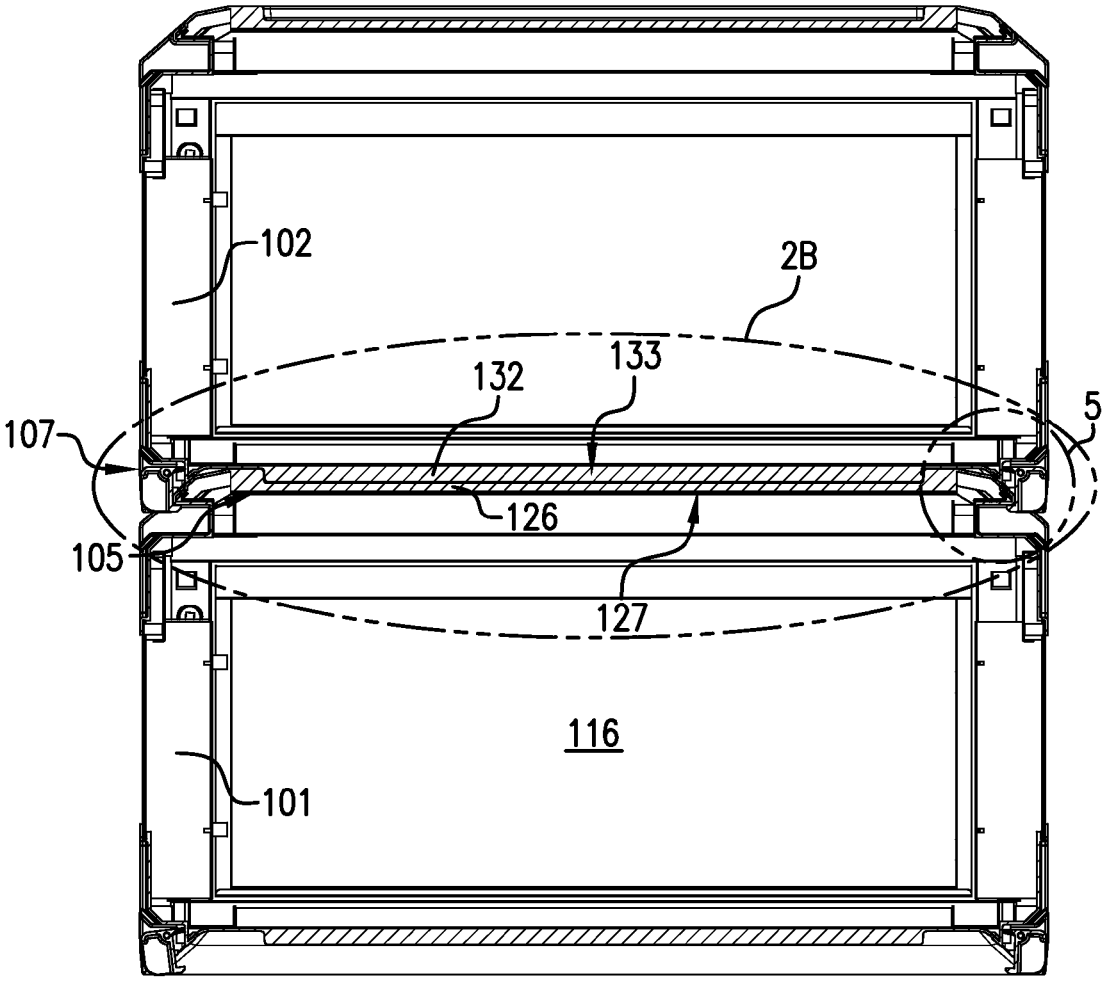
FIG. 2A shows a cross-sectional view of the storage container assembly system taken along the line 2-2 of FIG. 1A, but with a first container and a second container connected together.
Figure 2B:
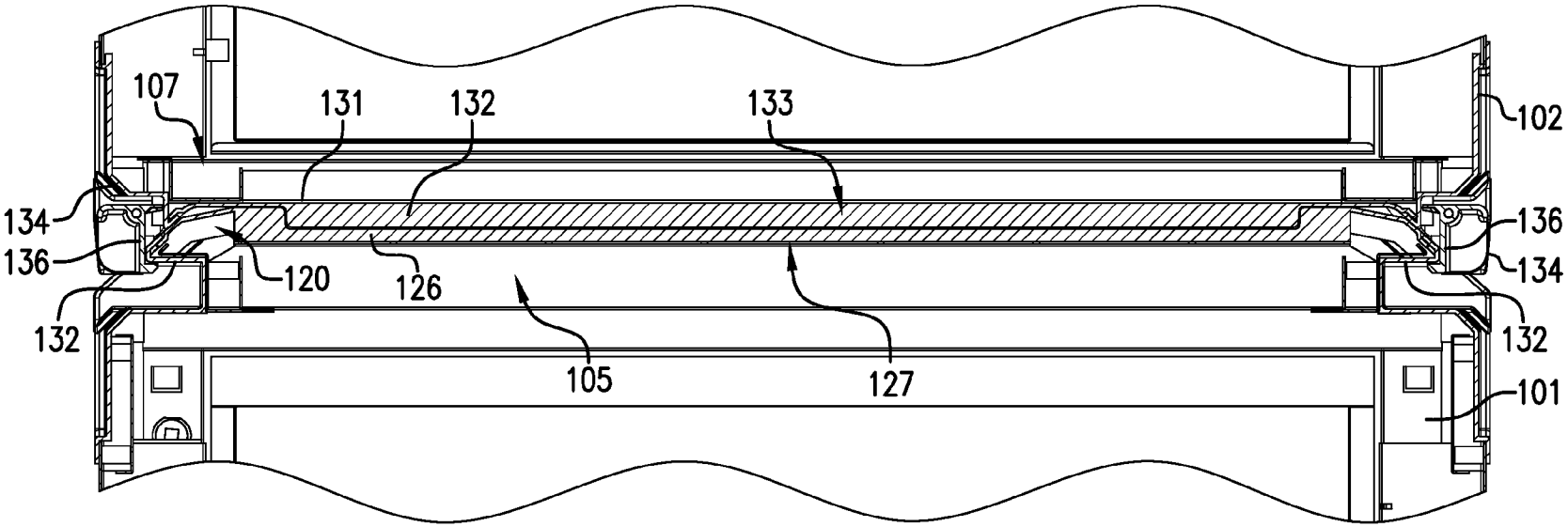
FIG. 2B shows a close up view of area 2B of FIG. 2A.
Figure 3A:
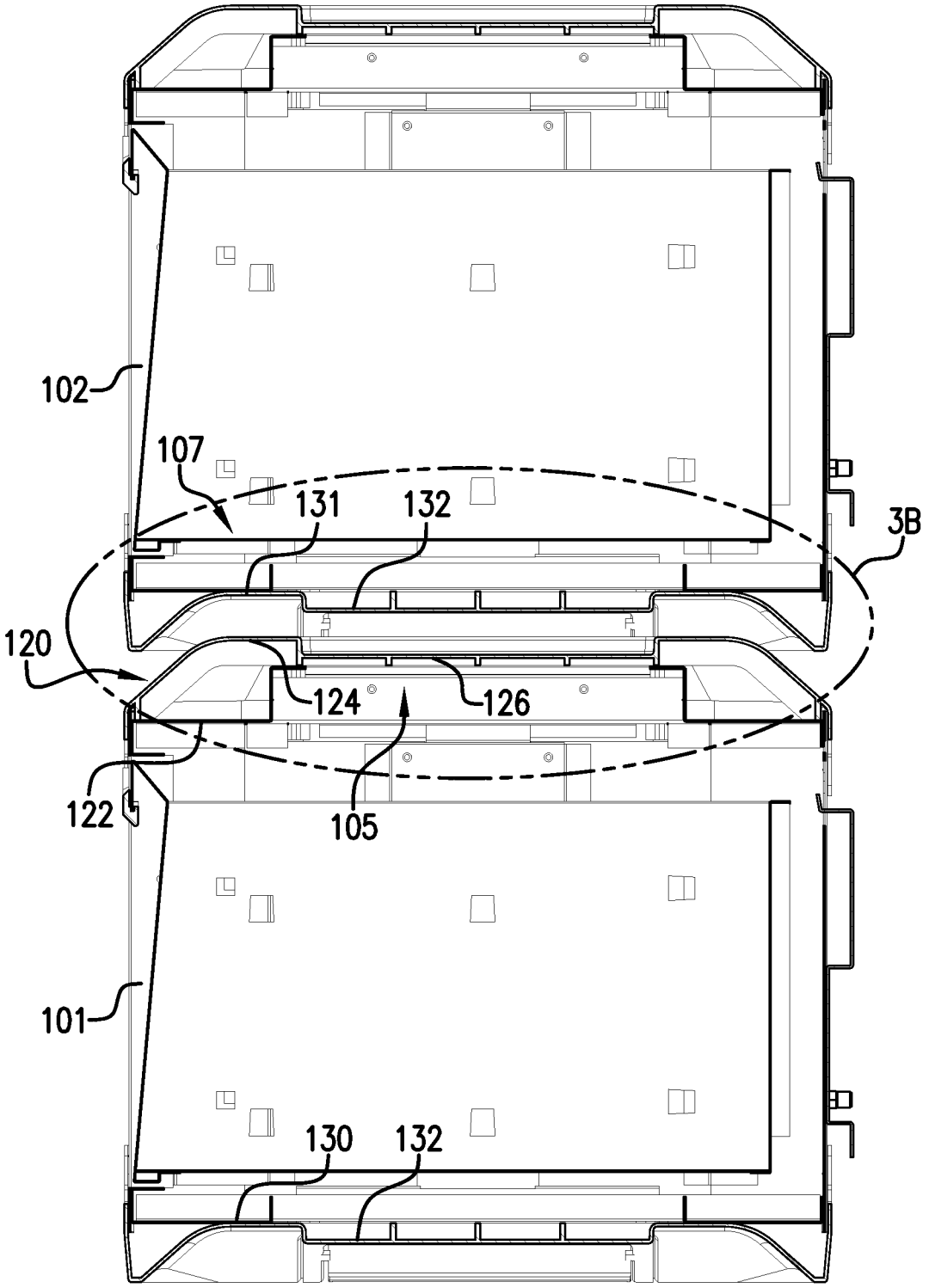
FIG. 3A shows a cross-sectional view of the storage container assembly system taken along the line 3-3 of FIG. 1A, but with a first container and a second container connected together.
Figure 3B:
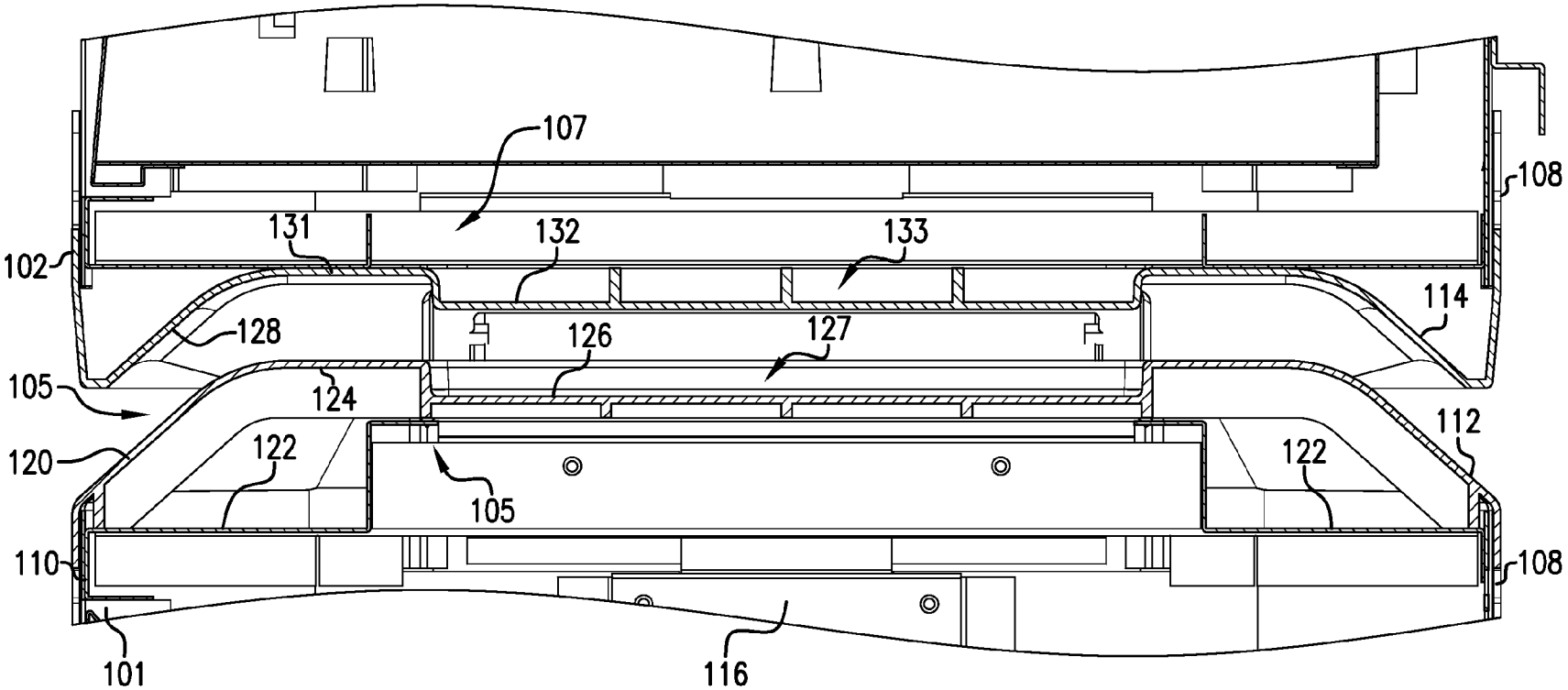
FIG. 3B is a close up view of area 3B of FIG. 3A.

As shown in FIGS. 2, 3A, and 3B, container 101 is constructed to nest with other containers. In this regard, container 101 has a pair of dual locating devices 105 and 107 on top 112 and bottom 114, respectively. Top locating device 105 on top side 112 of container 101 has a first portion 120, which is a male locating projection, which projects upward from a first plane defined by a bottom 122 of top side 112. First portion 120 projects upward at generally a forty-five degree (45°) angle with respect to bottom 122 of top side 112, but such angle can be any angle between 1° and 89°. First portion 120 transitions to a second portion 124 that is substantially parallel with bottom 122 of top side 112. Second portion 124 transitions to a third portion 126, which is a female locating recess, that is substantially parallel with bottom 122 of top side 112 but elevated lower (toward bottom 122 of top side 112) then second portion 124 creating a depression between second portion 124 on left side 110 and second portion 124 on right side 108 of container 101.

With reference to container 102 continuing with FIG. 3B, container 102 nests on top of container 101. Bottom locating device 107 is on bottom side 114 of container 102. Bottom 102 is bounded by a perimeter of the bottom side 114 of container 102 so that locating device 107 is located above the perimeter of bottom side toward interior space 116. Locating device 107 has a first portion 128 that projects inward toward interior space 116 with a transition to a second portion 131, which is a female locating recess, that is substantially parallel to a plane defining the bottom of bottom side 114 (and parallel to second portion 124 of top side 112). Second portion 131 transitions to a third portion 132, which is a male locating projection, that is substantially parallel with second portion 131 but elevated lower (away from top side 112 of second container 102) then second portion 131 creating a protrusion between second portion 131 on left side 110 and second portion 131 on right side 108 of container 102.

Figure 5:
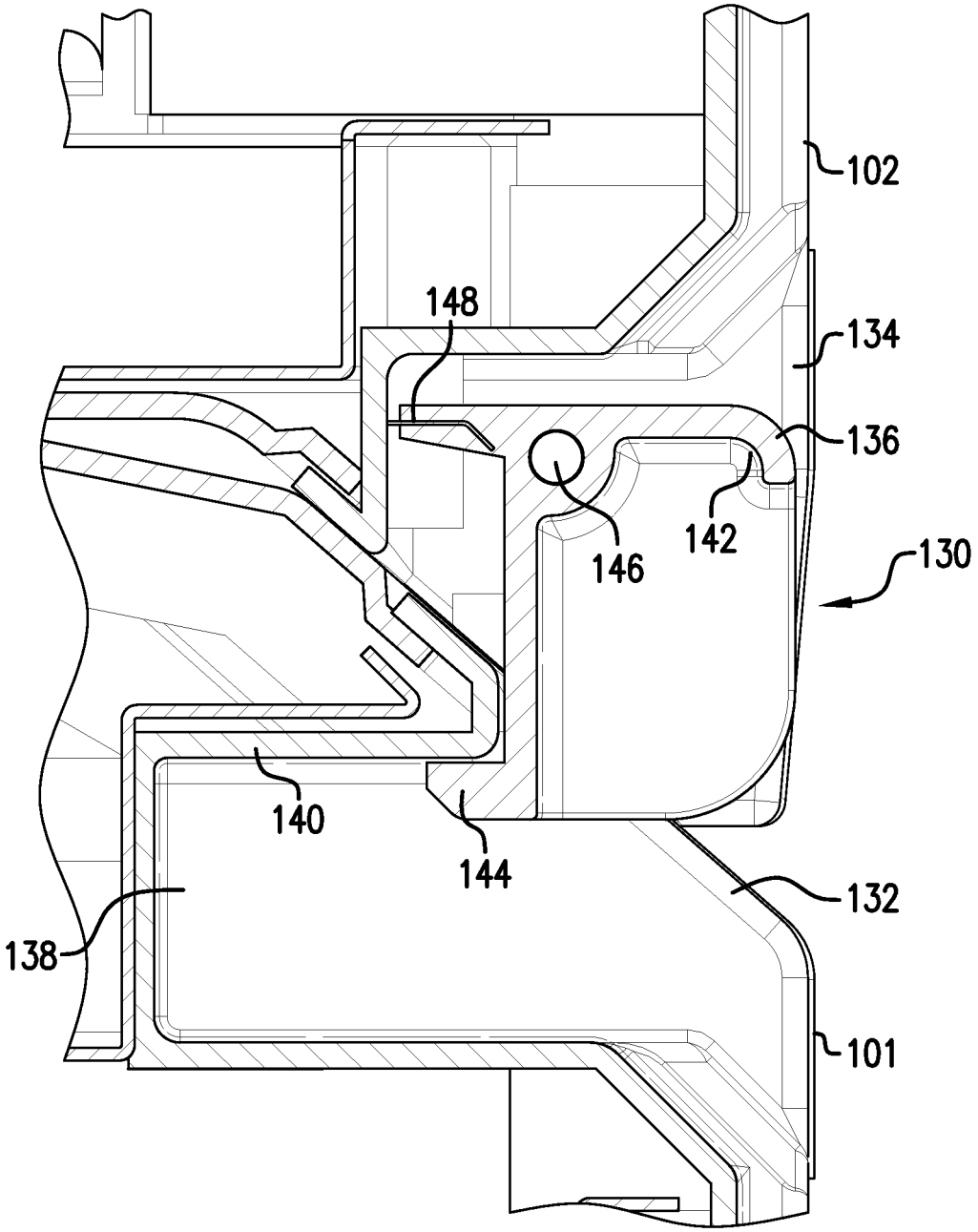
FIG. 5 is a close up view of area 5 from FIG. 2.

With second container 102 nested on top of first container 101, as shown in FIGS. 2 and 5, first portion 120 and second portion 124 of top side 112 of container 101 are locked from latitudinal and longitudinal movement in either direction by first portion 128 and third portion 132 of bottom side 114 of second container 102, and vice versa. Similarly, third portion 126 of top side 112 of container 101 and third portion 132 of bottom side 114 are locked together to prevent latitudinal and longitudinal movement in either direction. This nesting arrangement between top side 112 of container 101 and bottom side 114 of container 102 creates a sturdy structure for system 100 with a substantially smooth transition between containers 101, 102 to provide an appearance of a unitary and integral system 100.

Figure 4:
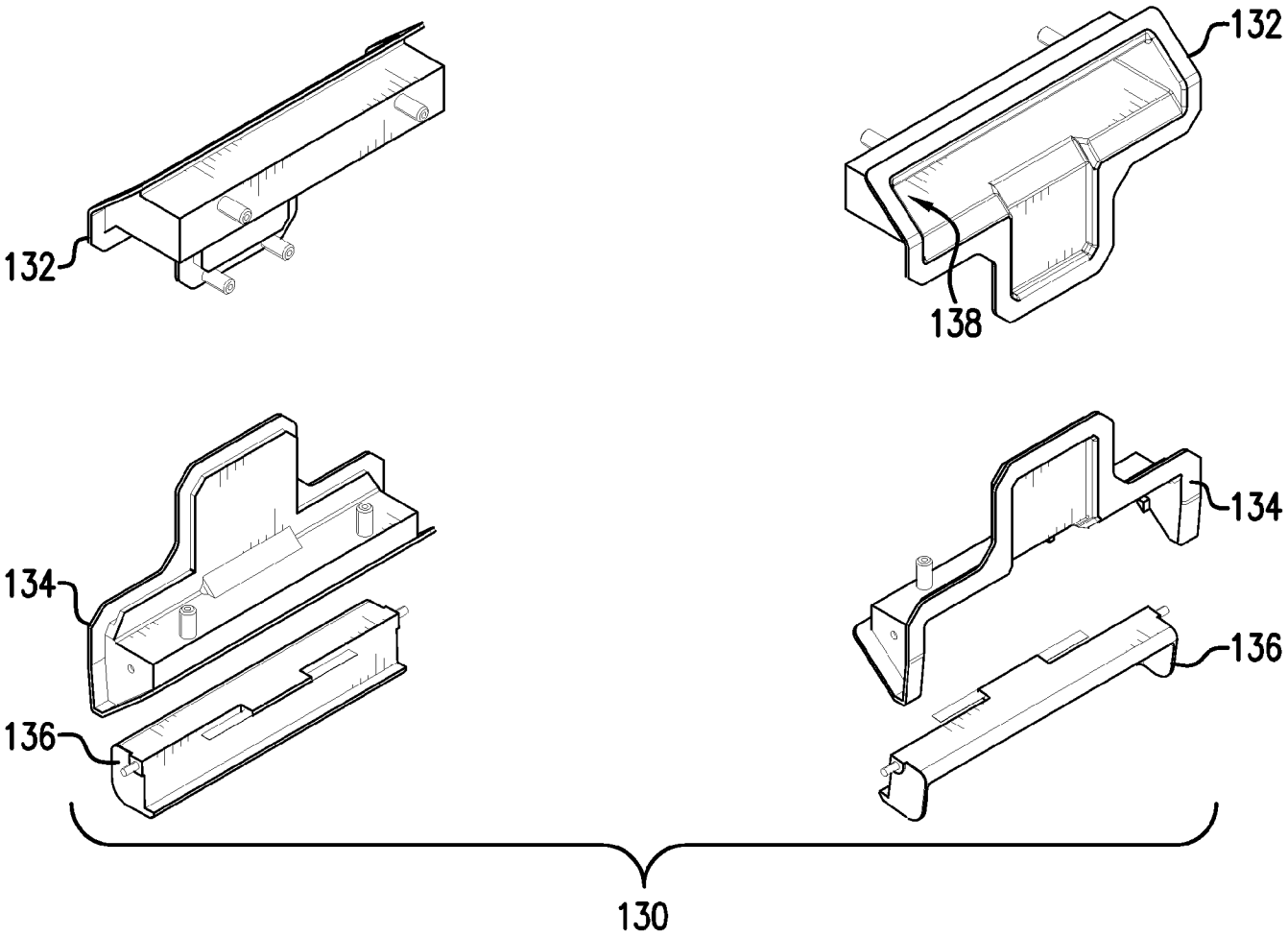
FIG. 4 is an exploded view of a container latching assembly.
Figure 6:
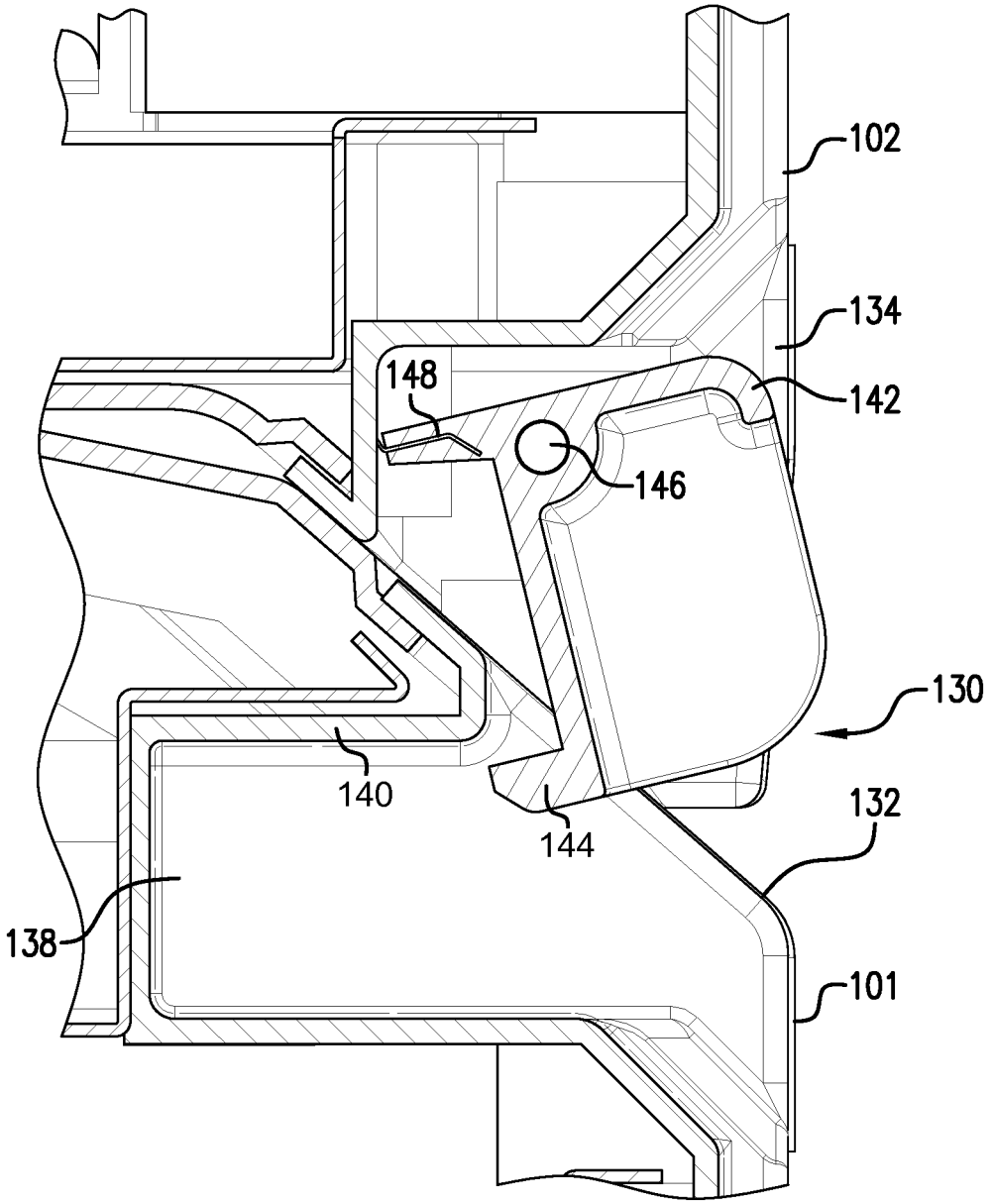
FIG. 6 shows the container latching assembly in an unlatched position.

Containers 101 and 102 can be mechanically locked together by a container latching mechanism 130. FIG. 4 shows an exploded view of container latching mechanism 130, FIG. 5 shows container latching mechanism 130 of container 102 engaged to container 101, and FIG. 6 shows container latching mechanism 130 of container 102 pivoted away from the engaged position. Container latching mechanism 130 includes a first housing 132 positioned near the top on one or both of right side 108 and left side 110, a second housing 134 positioned near the bottom of one or both of right side 108 and left side 110, and a biased latch 136 that is pivotally connected to second housing 134.

FIG. 5 shows container latching mechanism 130 of container 102 engaged to container 101. First housing 132 includes a handle 138 that is an open area of sufficient length bounded by a top wall 140 to provide a gripping area or handle for a user's hands to carry container 101. Top wall 140 also functions as a "catch" for latch 136 to attach container 101 to container 102. Latch 136 includes a gripping portion 142 to receive a user's hand for pivoting latch 136 about pivot point 146 and a projection 144 that engages top wall 140. A spring 148 returns latch 136 back to the engaged position when latch 136 is released. In operation, a user grabs gripping portion 142 and pivots latch 136 outward, as shown in FIG. 6. At this point, container 102 can be set on top of container 101 and latch 136 can be released. Projection 144 of latch 36 on container 102 engages top wall 140 of first housing 132 of container latching mechanism 130 of container 101 to hold the respective containers 101 and 102 together. Latch 136 is substantially flush with the side of container 102.

Container 101 (as well as any other container 102, 700, 800, and 900) can be made of a combination of metal and molded plastic parts. In an embodiment, container 101 has a metal frame made 200 from assembling one or more sheets of stamped sheet metal. Metal frame 200 has a front side 204, back side 206, right side 208, left side 210, top side 212, and bottom side 214 that correspond with the sides 104, 106, 108, 110, 112, and 114, respectively, of the same name of container 101. Top side 212 and bottom side 214 of frame 200 can have a substantially open interior to decrease weight and cost. Back side 206 can have a round opening 216 for power cords so a power extension strip or the like could be mounted inside container 101. Multiple openings 218 can be formed around all sides 204-214 of frame 200 for engaging corresponding protrusions in the molded plastic covers.

Top side 112 and bottom side 114 of container 101 are made substantially of a molded plastic cover 220 and 222, respectively, that snap on to top side 212 and bottom side 214 of frame, respectively. Container latching mechanism 130 can be made substantially of a molded plastic and attached to each right side and left side of frame 210. An additional metal support 224 can be attached to each side of frame 210 between first housing 132 of container latching mechanism 130 and right side and left side of frame 210 for additional strength around the area that forms the carrying handle, i.e. open area of handle 138 of first housing 132 of container latching mechanism 130.

Alternative arrangements of system 100 with multiple containers 191, 102, 700, 800, and 900 are contemplated. One such alternative includes a moveable platform that has a substantially flat base on four wheels or casters with a latching mechanism 130. The platform has a first housing 132 of latching mechanism 130 on the right side and the left side of the platform. The biased latch 136 connected to second housing 134 on each side of the container connects to the first housing on the platform in the manner described above with respect to connecting container 102 to container 101 whereas container 101 is replaced with the platform. This arrangement creates a movable system.

Various aspects of any of the embodiments can be combined in different combinations than the ones shown to create new embodiments that fall within the scope of the appended claims. The containers can be stacked in any arrangement with one on top of the other, and the container latching mechanism and the dual pair of locating devices will hold the containers together. The container latching mechanism can also connect to containers side-by-side to form a vertical and horizontal container storage assembly system.

While the present invention has been particularly shown and described with reference to exemplary embodiments thereof, it should be understood by those of ordinary skill in the art that various changes, substitutions and alterations can be made herein without departing from the scope of the invention as defined by appended claims and their equivalents. The invention can be better understood by reference to the following claims. For purpose of claim interpretation, the transitional phrases "including" and "having" are intended to be synonymous with the transitional phrase "comprising."

What is claimed is:

1. A container assembly for combining a first container with a second container, the first container comprising:

a first bottom side and a first top side;

a female locating recess on the first top side including a plurality of sides;

a male locating projection on the first bottom side including a plurality of sides surrounding a bottom surface wherein the bottom surface of the male locating projection is located above a plane defined by a perimeter of the bottom side; and wherein the female locating recess is nestingly engageable with the male locating projection of the second container with the one of each of the plurality of sides of the female locating recess touching one of each of the plurality of sides of the male locating projection restrict movement of the first container and the second container with respect to each other in a latitudinal and a longitudinal direction.

2. A container assembly for combining a first container with a second container, the first container comprising:

a first bottom side and a first top side;

a female locating recess on the first top side including four sides;

a male locating projection on the first bottom side including four sides surrounding a bottom surface wherein the bottom surface of the male locating projection is located above a plane defined by a perimeter of the bottom side; and wherein the female locating recess is nestingly engageable with the male locating projection of the second container with one of each of the four sides of the female locating recess touching one of each of the four sides of the male locating projection to restrict movement of the first container and the second container with respect to each other in a latitudinal and a longitudinal direction.

3. The container assembly of claim 2, wherein the first container has a first right side and a first left side, wherein the first container further comprises a first container latching mechanism moving between a latched position and an unlatched position for connecting the first container to another container, wherein the first container latching mechanism is positioned on the first right side or the first left side of the first container.

4. The container assembly of claim 3, wherein the first container latching mechanism further comprises a first catch positioned substantially near the first top side of the first container to connect the second container to the first container.

5. The container assembly of claim 4, and further comprising the second container, wherein the second container further comprises a second bottom side and a second top side; a female locating recess on the first top side including four sides; a male locating projection on the second bottom side including four sides; and a second container latching mechanism for connecting the first container to the second container.

6. The container assembly of claim 5, wherein the female locating recess on the first top side is surrounded by a first portion that projects outward with respect to an interior portion of the first container and surrounds the female locating recess, wherein the male locating projection on the second bottom side of the second container is surrounded by a first portion that projects inward with respect to an interior portion of the second container and surrounds the male locating projection.

7. The container assembly of claim 6, wherein second container latching mechanism is positioned on a second right side or a second left side of the second container, and further comprises a second latch positioned substantially near the second bottom side of the second container, wherein the second container latching mechanism further comprises a second catch positioned substantially near the second top side of the second container.

* * * * *